US007874057B1

(12) United States Patent
Rickards

(10) Patent No.: US 7,874,057 B1
(45) Date of Patent: Jan. 25, 2011

(54) METHOD FOR PERFORMING VEHICLE MAINTENANCE AND REPAIR

(75) Inventor: John Rickards, Mechanicsburg, PA (US)

(73) Assignee: Team Rahal VMS, Mechanicsburg, PA (US)

( * ) Notice: Subject to any disclaimer, the term of this patent is extended or adjusted under 35 U.S.C. 154(b) by 1161 days.

(21) Appl. No.: 11/525,713

(22) Filed: Sep. 21, 2006

Related U.S. Application Data

(60) Provisional application No. 60/719,764, filed on Sep. 23, 2005.

(51) Int. Cl.
*B21D 39/03* (2006.01)

(52) U.S. Cl. ..... 29/430

(58) Field of Classification Search ..... 29/430, 29/431, 429, 402.01, 402.08, 402.03, 703, 29/771, 783, 791, 824; 52/236.3
See application file for complete search history.

(56) References Cited

U.S. PATENT DOCUMENTS

| | | | | |
|---|---|---|---|---|
| 2,872,709 | A | 2/1959 | Brem | |
| 3,079,871 | A | 3/1963 | Brodie | |
| 3,621,869 | A | 11/1971 | Albarran | |
| 3,866,624 | A | 2/1975 | Peterson | |
| 4,188,985 | A | 2/1980 | Osterman | |
| 4,284,173 | A | 8/1981 | Patterson | |
| 4,789,047 | A | 12/1988 | Knobloch | |
| 4,987,973 | A | 1/1991 | Cody | |
| 5,634,503 | A | 6/1997 | Musil et al. | |
| 5,701,706 | A | 12/1997 | Kreysler et al. | |
| 5,833,294 | A | 11/1998 | Williams et al. | |
| 6,189,272 | B1 | 2/2001 | Deiss et al. | |
| 6,539,678 | B1 | 4/2003 | Campbell et al. | |
| 7,530,152 | B2 * | 5/2009 | Giarrizzo, Jr. | 29/402.08 |
| 2002/0111844 | A1 | 8/2002 | Vanstory et al. | |
| 2003/0158640 | A1 | 8/2003 | Pillar et al. | |

* cited by examiner

*Primary Examiner*—John C Hong
(74) *Attorney, Agent, or Firm*—McNees Wallace & Nurick LLC

(57) ABSTRACT

A wheel trolley assembly that enables easier and more efficient tire rotation is provided. Various service stations, one of which includes the wheel trolley assembly, are arranged sequentially one after the other by means of a series of conveyor means, each positioned in a manner which allows them to rotate independently of one another, while at the same time facilitating the transfer of vehicles from one station to the next. The wheel trolley assembly and series of independently-moving conveyors greatly increase the efficiency and speed of vehicle service, thereby increasing the volume of vehicles which can be serviced as well as customer satisfaction levels.

6 Claims, 4 Drawing Sheets

METHOD FOR PERFORMING VEHICLE MAINTENANCE AND REPAIR

FIELD OF THE INVENTION

The present invention relates generally to a system and method for servicing vehicles. More particularly, the present invention includes a tire changing system, and series of conveyor belts which enable repair and maintenance work to be performed in assembly-line fashion. Additional servicing stations may be positioned along the line, either before or after the tire changing system.

BACKGROUND

In the vehicle service business, a vehicle in need of repair (due to, for example, damage to the vehicle or a part failure) or routine maintenance (such as, for example, an oil change) is usually brought to a body shop, automobile dealer or similar vehicle service facility for corrective measures. With regard to maintenance work in particular, there are a number of tasks that must be regularly performed on virtually every vehicle, in order to keep it in proper or optimum working order (such as tire rotation; checking and filling oil, automatic transmission fluid, windshield washer fluid, coolant and other basic automotive fluid levels; checking and filling tire air pressure; etc.), and periodically to assure compliance with any applicable state and federal regulations (related to, for example, annual state registration, environmental standards, etc.).

To repair or maintain such vehicles, the vehicle service facility must have available a device, usually called a "rack" or a "frame pulling" bench, which can be expensive and can take up valuable space in a vehicle service facility. For certain tasks, some type of elevation device, such as a hydraulic lift, must be employed in order to suspend the vehicle above floor level. However, not all tasks require the use of a lift. Some may be (or must be) performed while the vehicle is at ground level, with its tires resting on the floor. For example, an oil change may be performed via a sub-surface pit or chamber, wherein the technician is positioned within the pit and the vehicle then moved above the pit so as to allow the technician, while standing beneath the vehicle, to have access to its underside. In addition, many of the steps involved in a routine annual state inspection (such as checking the headlights and taillights, for example) do not require that a lift be used.

A vehicle in need of several different maintenance tasks can be serviced by one or more technicians at a time, each performing a specific task before proceeding on to the next task, etc., until all of the desired tasks have been performed. This can be quite time-consuming depending upon the number of tasks involved. To have all of the required tasks performed simultaneously would save time, but is usually impractical because multiple technicians would have to be working on the vehicle at the same time, tending to get in each other's way and make coordination of efforts much more difficult. Aside from this, a vehicle in need of a number of tasks is not amenable to simultaneous task performance where some of the tasks require the use of a lift and some do not. Checking the headlights during a state inspection, for example, would normally take place with the vehicle on the ground, its tires resting on the floor surface. Tire rotation, however, would require the vehicle to be suspended above the ground. Thus in that situation, checking of the lights and rotating the tires would have to take place in sequence rather than simultaneously, thereby adding to the time required to service such a vehicle. Extra time is often viewed negatively by customers in need of fast service. Moreover, extra time means increased labor costs. For a service facility with only a limited number of service bays, the extra time also means being unable to service a large volume of vehicles because a vehicle cannot be brought in to the facility for service until there is an open service bay to house the vehicle. The longer the vehicles remain in the bays while being serviced, the longer it takes for subsequent incoming vehicles to be brought in to the bays and serviced.

Attempts to increase the number of vehicles that can be serviced have been made via the use of conveyor, such as in U.S. Pat. No. 4,987,973 to Cody. There, a continuously moving conveyor moving over a pit is utilized, such that vehicles may be continually placed onto one end of the conveyor and continually discharged from the opposite end. All servicing takes place while the vehicles move along the conveyor. A major problem associated with this system is that it requires the mechanics servicing a particular vehicle to walk alongside (or underneath, if in the pit) the vehicle as it travels along the conveyor while performing their particular task(s). Having to walk with the vehicle, versus standing at or around a stationary vehicle, can be much more difficult depending upon the task involved. Additionally, if a mistake is made or for whatever reason one of the technicians along the line is unable to complete his task in the time allotted, the vehicle will either pass on to the next stage in the process without the task having been completed, or the entire moving conveyor will have to be stopped so as to allow the technician in question to complete his task or rectify any mistakes. Such a stoppage temporarily prevents other cars on the conveyor (both those ahead and those behind the vehicle that necessitated stoppage) from moving further down the line. Thus but for the stoppage in the conveyor, those other vehicles which are fully serviced and otherwise ready to be moved on to the next service stage must sit idle—not to mention any upstream and downstream mechanics who must similarly remain idle. Some tasks, such as tire rotation, would be virtually impossible to perform on a moving vehicle. Lastly, this system also is designed for a continuous stream of vehicles in need of service or repair. In reality, there will be peaks of incoming vehicles throughout the day, such that there will ordinarily not be a continuous stream.

In addition to the variety of tasks that may be involved in providing automotive repair and maintenance services, vehicle bodies and frames come in many different shapes and sizes. Further, the servicing of modern automotive vehicles has become extremely complicated. Beyond the complexity of individual parts of a vehicle's drive system, the specifications for some vehicles are further complicated by the many options that are available to the vehicle owner in body style, engine size and type, transmission, and accessory equipment. Some vehicles even have different specifications depending upon the factory where the vehicle was assembled or the time in the model year when the vehicle was completed. In some cases manufacturers have changed specifications on particular vehicle engines because of design improvements, original errors or changes in regulations.

Automotive technicians or mechanics cannot be expected to be familiar with the specifications of every make and model of vehicle. Many manufacturers supply some essential vehicle specifications in readable form fixed to the vehicle. Such specifications provide identification for the vehicle and other pertinent information that will enable a person servicing the vehicle to identify vehicle and engine specifications. Nevertheless, if changes are made in the vehicle, the identification fixed to the vehicle may no longer apply. Further, if the manufacturer or a regulatory agency makes changes that apply to a particular vehicle, those changes will not be known from a reference to the specifications fixed to the vehicle. Certain specifications may be unusual or simply may not be the type that is ordinarily fixed to the vehicle. So in addition to the time spent actually servicing the vehicle, mechanics must spend time obtaining, locating and retrieving the relevant specifications for the specific vehicle they happen to be servicing at the time.

Therefore, the need exists for a system and method of servicing automotive vehicles, which increases the efficiency and the speed at which vehicles can be serviced, is capable of accommodating vehicles of all shapes, sizes, makes and models, and possesses the ability to provide a wide range of services including both those that can be done while the vehicle is at floor level and those that require the vehicle to be suspended via a lift.

SUMMARY OF THE INVENTION

The method of the present invention provides a single system to meet each of the foregoing needs. It includes a novel wheel trolley assembly that enables easier and more efficient tire rotation. It can also include one or more additional services ordinarily required in the regular maintenance of vehicles. The system and method includes stations. At each station, a particular task is performed. The collection of stations is then arranged sequentially one after the other by means of a series of conveyor belts, each positioned in a manner which allows them to rotate independently of one another, while at the same time facilitating the transfer of vehicles from one station to the next.

DESCRIPTION OF THE INVENTION

Figure 1:
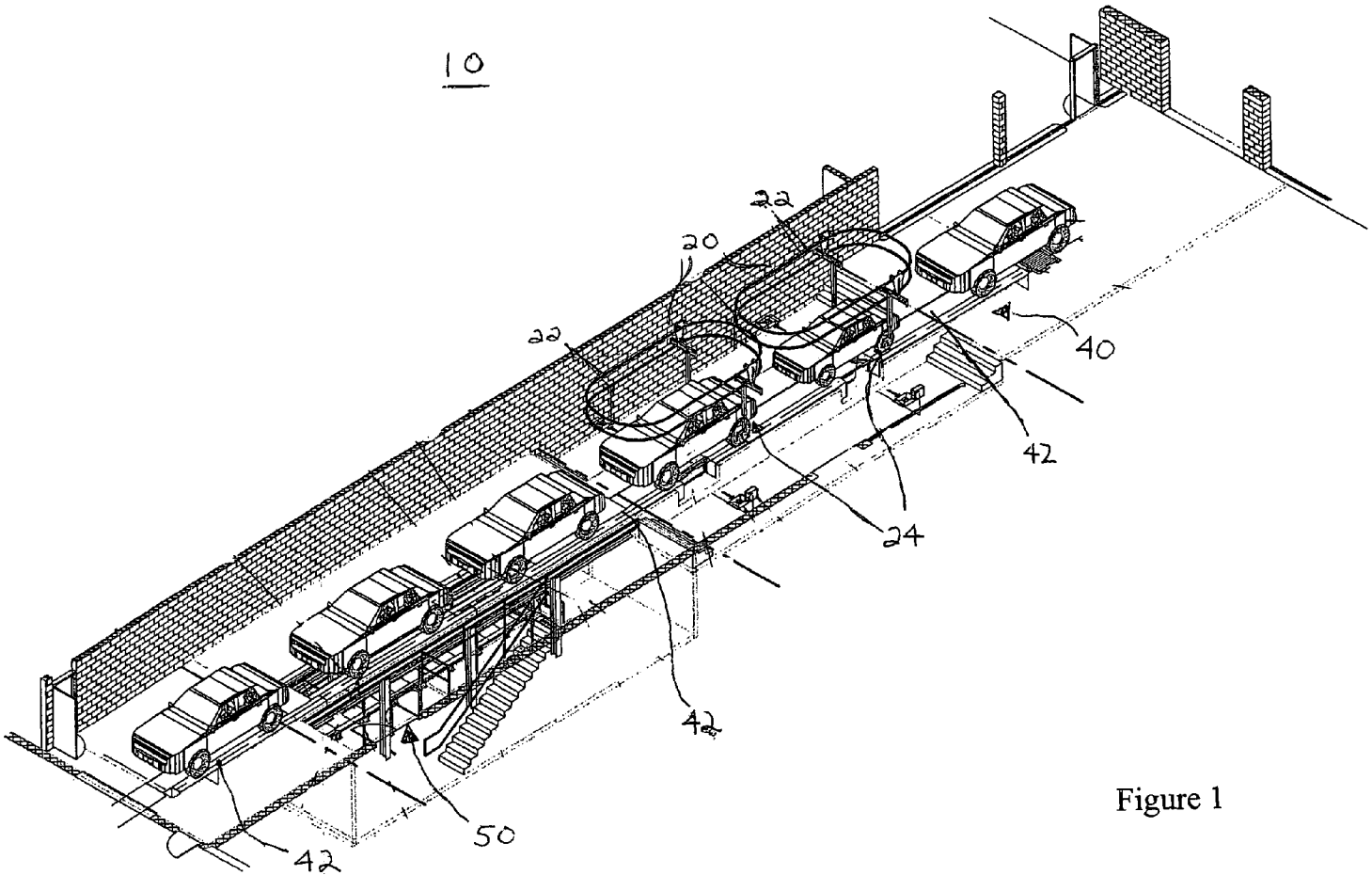
FIG. 1 is a perspective view of an illustrative embodiment of the vehicle servicing system and method of the present invention.
Figure 2:
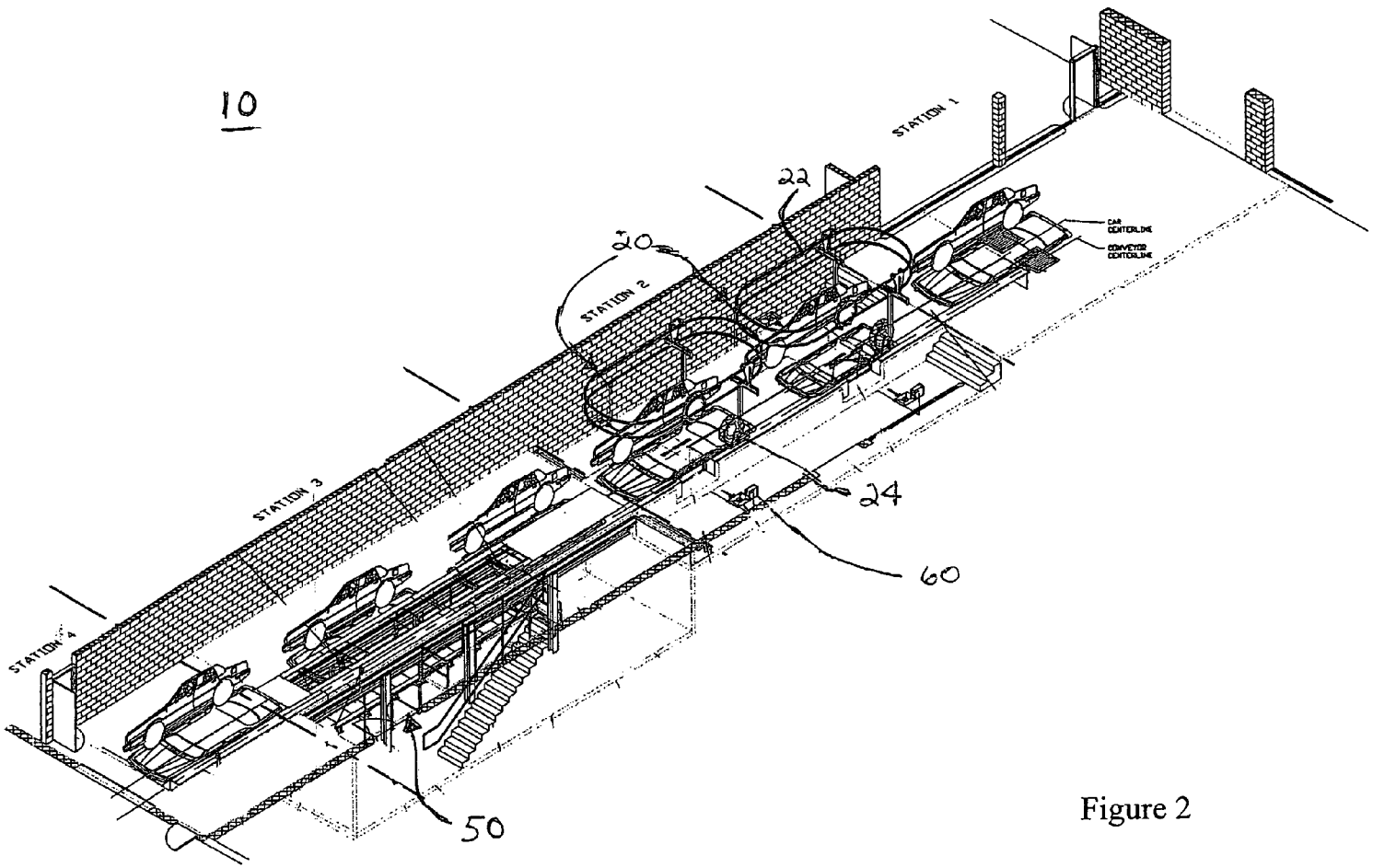
FIG. 2 is a modified perspective view of the embodiment shown in FIG. 1.
Figure 3:
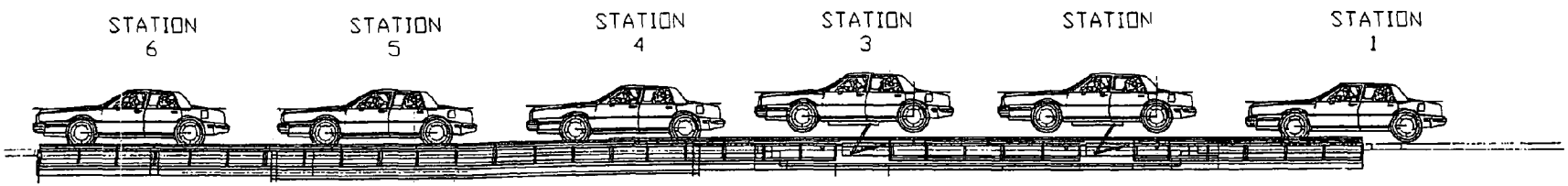
FIG. 3 is a side elevational view of another embodiment of the system and method of the present invention.

The present invention provides a system and method for servicing and performing maintenance on vehicles in an assembly-line fashion, to provide greater efficiency. The system and method of the present invention enables the servicing of two to three times the number of cars that would otherwise be possible in the same amount of time using conventional systems and methods. One embodiment of the vehicle servicing system 10 of the present invention is shown in FIGS. 1 and 2.

Figure 4A:
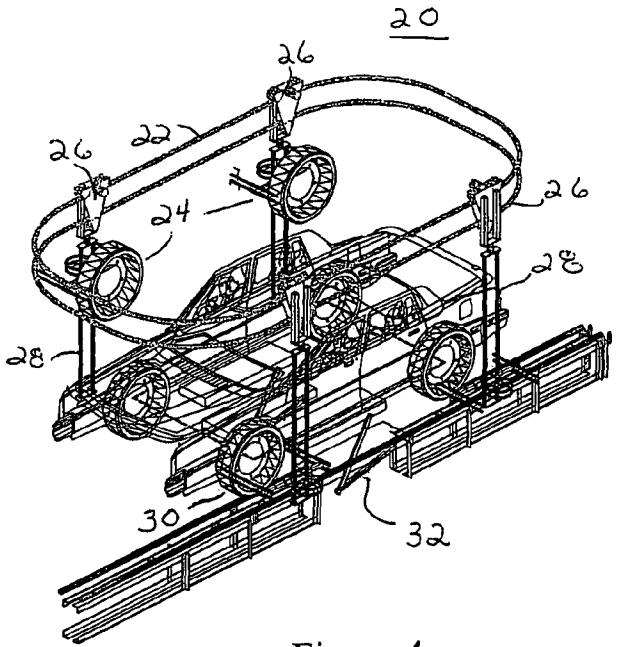
FIG. 4*a* is a perspective view of the wheel trolley assembly of the present invention.
Figure 4B:
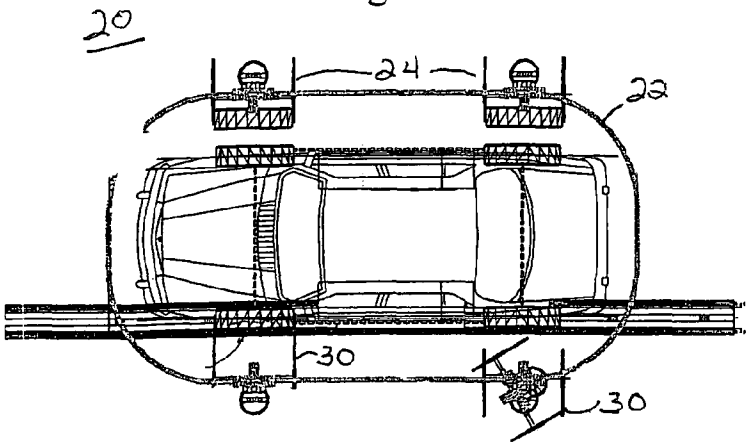
FIG. 4*b* is a top plan view of the wheel trolley assembly of FIG. 4*a*.
Figure 4C:
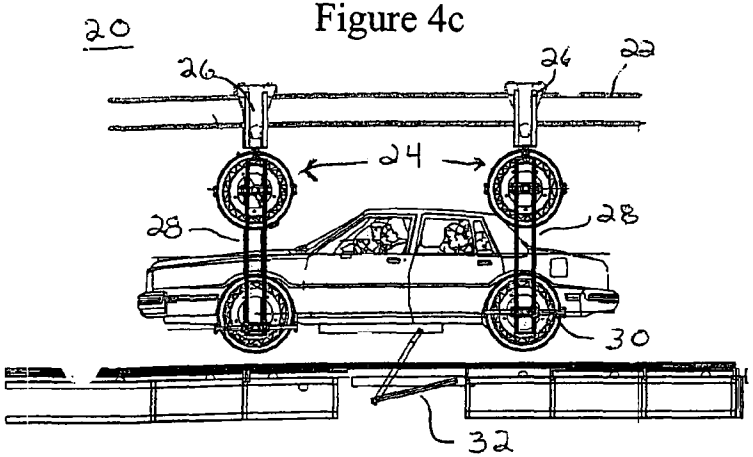
FIG. 4*c* is a side elevational view of the wheel trolley assembly of FIG. 4*a*.

The invention achieves these results in part through the use of a novel wheel trolley assembly 20. As shown in more detail in FIGS. 4*a*, 4*b* and 4*c*, wheel trolley assembly 20 includes wheel handler track 22 which is generally rectangular in shape although rounded at the corners. Wheel handler track 22 is located to enable a vehicle to pass underneath it, and be positioned directly below it for purposes of rotating the vehicles tires. For example, wheel handler track 22 may be supported from the service facility's roof trusses.

Slidably mounted to wheel handler track 22 is one or more (preferably one for each tire) tire handlers 24. Tire handlers 24 may be manually moved into position near any one of the tires. Optionally, tire handlers 24 could be controlled via computer, so as to automatically travel the proper position on wheel handler track 22 depending on the vehicle being serviced. Each tire handler 24 is slidably attached to wheel handler track by support 26, which includes pulleys or the like to allow for slidable movement. Downwardly extending from each support 26 is vertical member 28, from which in turn extends U-shaped member 30 perpendicular to vertical member 28 pointing inward toward the vehicle. A lift 32 is positioned underneath the vehicle.

In operation, once a vehicle is in place to have its tires rotated, a technician activates the lift, raising it sufficiently above ground level, and positions a tire handler 24 near each of the tires to be rotated. Tire handler 24 is constructed so as to allow the technician to raise or lower vertical member 28 to align it to the proper height for each tire. Similarly, tire handler 24 is constructed so as to allow the technician to move U-shaped member 28 inward, closer to the tire. Once tire handler 24 is in position, the technician removes the lugnuts that hold the tire to the wheel and with relative ease pulls the tire off of the wheel and onto U-shaped member 28.

Once each tire has been removed and placed on U-shaped member 28, the technician may then slide tire handlers 24 about the wheel handler track 22 until each of the tires is positioned near its new location. Thereafter, the tires may be placed back onto the wheels with relative ease, the lugnuts reattached, and the task of rotating the tires completed. The wheel trolley assembly of the present invention thereby places far less physical strain on the technicians than is ordinarily required using traditional means to rotate a vehicle's tires.

In addition to novel wheel trolley assembly 20, improved efficiency in servicing vehicles is achieved by employing a novel conveyor system 40. Conveyor system 40 includes two or more conveyor belts or tracks 42 or the like. Conveyor belts 42 are arranged end-to-end close enough to allow a vehicle to be passed from one belt to the next closest belt along the line of travel, but separate enough so that each belt can turn independently of the other belt(s).

In an embodiment of the vehicle servicing system and method according to the current invention, as shown in FIGS. 1 and 2, vehicles enter the system at an entry point, identified as "Station 1" in FIGS. 1 and 2. Thereafter, a series of conveyor belts 42 is arranged end-to-end for servicing vehicles in an assembly-line fashion. At least one conveyor belt 42 corresponds to a different service station, at which various tasks may be performed. In FIGS. 1 and 2, the conveyor belts 42 are arranged longitudinally along the line of travel and positioned so that the stations identified as Station 2, Station 3 and Station 4 each have at least one conveyor belt.

At one of the stations, shown as Station 2 in FIGS. 1 and 2, one or more of the wheel trolley assemblies 20 of the present invention may be placed. For services that require access to the underside of the vehicle, another station may include a sub-surface pit 50 below one of the belts, such as is shown in FIGS. 1 and 2 at Station 3. Another station may be included solely for tasks that require neither the use of a lift or a pit, but rather can be performed while the vehicle is at ground level, resting on its tires.

The number of conveyor means and the number of stations can vary as desired. Similarly, the tasks that can be performed at any given station run the full gamut of services ordinarily available at a typical vehicle service facility, and are not listed individually here as those skilled in the art are readily familiar with the types of services that may be provided. Likewise, the sequence of tasks can be arranged in any manner desired. In an embodiment where, for example, the system and method include three service stations—tire rotation, oil change and state inspection—the stations could be arranged in that order (tire rotation first, followed by oil change, followed by state inspection), or could be arranged in any combination thereof (oil change/state inspection/tire rotation; state inspection/tire rotation/oil change; and so forth), as will be fully understood by those skilled in the art. If desired, the final station can be equipped as a car wash unit.

Operator is responsible for the main control panel (not shown), at which information regarding the make, model and year of the cars to be serviced is entered, along with the service(s) to be performed. Detailed specifications will have been previously obtained and entered into the system for the different makes and models to be serviced at a particular service facility, such that when the operator enters the make, model and year of a vehicle in need of service, the specifications associated with that vehicle will be automatically retrieved. Relevant information is then conveyed to the service technicians working on the line. Each station may include one or more operator interface panels 60, in electronic communication with the main control panel. By way of example only, information regarding a particular vehicle's optimum tire pressure will be important to the technician(s) operating the wheel trolley assembly. Operator interface panels 60 provide the technicians with information regarding the services to be performed on each vehicle and its specifications. Again by way of example only, operator interface panels 60 can instruct the technicians as to whether a vehicle's tires are to be rotated front to back (exchanging front left tire with rear left tire, and front right tire with rear right tire), side to side (exchanging front left tire with front right tire, and rear left tire with rear right tire), or criss-cross (exchanging left front tire with right rear tire, and right front tire with left rear tire). The technicians can also enter data into the panels 60, such as recording any diagnostic measurements they may have made, providing confirmation that the various required tasks were in fact performed, and the like. The data entered into the main control panel regarding the mark and model of the vehicle to be serviced can also be used to automatically adjust the height of the lift as control the amount of oil and other liquids to be installed in the vehicle.

The technicians at each station control when their respective conveyor means are activated so as to pass the vehicle along to the next belt/station. This avoids the problems associated with the prior art that required the vehicles to all move at the same time and at the same speed. In the present invention, vehicles near the end of the line are not dependent on, for example, the progress of a vehicle in the middle or front of the line.

Each station is equipped with the various machinery (hoses for dispensing fluids, wheel balancers, etc.), tools and supplies (fluids, parts, etc.) necessary for the tasks that are to be performed at the station. Again, those skilled in the art will fully appreciate which tasks can be performed, as well as the corresponding equipment/products required for each task, and therefore it is unnecessary to identify them here in detail.

Vehicle servicing system 10 provides both manpower and space benefits to the operation of a vehicle service business. It has been found that up to twenty separate repair stalls, each serviced by their own technician, would be needed to provide the same capacity as one vehicle servicing system 10 manned by seven service line workers. In addition, because vehicle servicing system 10 can be staffed by service line workers, the higher skilled technicians are freed up to work on complex repairs and diagnostics.

While the present invention has been described with particular reference to the drawings, it should be understood that various modifications could be made without departing from the spirit and scope of the present invention.

I claim:

1. A method of servicing a vehicle comprising the steps of:

a) providing a service line having a plurality of stations, each station being staffed with at least one separate service operator;

b) performing a first service function on a vehicle at a first of said plurality of stations;

c) conveying said vehicle from said first station to a second of said plurality of stations on a first conveyor that extends from said first station to said second station, said first conveyor being operated by an operator in said first station;

d) performing a second service function on said vehicle at said second station;

wherein at least one of said plurality of stations is a tire changing station;

wherein said tire changing station comprises:

a track provided above said station at a height above the top of said vehicle, said track extending at least along one side of a vehicle positioned in said tire changing station; and at least one arm slidably attached to said truck, said arm extending downward from said track, said arm having a proximate end opposite said track for receiving and holding a tire, wherein said arm is adapted to carry said tire as said arm slides along said track.

2. The method of claim 1 further comprising the steps of:

e) conveying said vehicle from said second station to a third of said plurality of stations on a second conveyor that extends from said second station to said third station, said second conveyor being operated by an operator in said second station; and f) performing a third service function on said vehicle at said third station.

3. A method of servicing a vehicle comprising the steps of:

a) entering vehicle identification information into a first terminal connected to a processing unit;

b) performing a first service function on a vehicle at a first station;

c) optionally entering diagnostic information regarding said vehicle at a second terminal positioned at said first station, said second terminal connected to said processing unit;

d) conveying said vehicle from said first station to a second station on a conveyor that extends from said first station to said second station, said first conveyor being operated by an operator in said fire station;

e) performing a second service function on said vehicle at said second station;

f) optionally entering diagnostic information regarding said vehicle at a third terminal positioned at said second station, said third terminal connected to said processing unit;

g) conveying said vehicle from said second station to a third station on a second conveyor that extends from said second station to said third station, said second conveyor being operated by an operator in said second station;

h) performing a third service function on said vehicle at said third station; and i) optionally entering diagnostic information regarding said vehicle at a fourth terminal positioned at said third station, said fourth terminal connected to said processing unit;

wherein one of said stations is a tire changing station comprising a track provided above said station at a height above the top of said vehicle, said track extending at least along one side of a vehicle positioned in said tire changing station; and at least one arm slidably attached to said track, said arm extending downward from said track, said arm having a proximate end opposite said track for receiving and holding a tire, wherein said arm is adapted to carry said tire as said arm slides along said track.

4. The method of claim 3 further comprising the steps of:

j) raising said vehicle by a lift positioned at said tire changing station;

k) positioning at least one of said arms near a tire;

l) placing a tire on said at least one of said arms; and m) positioning said at least one of said arms near a wheel of said vehicle on which said tire is to be placed by sliding said at least one of said arms along said track.

5. A method of servicing a vehicle comprising the steps of:

a) entering vehicle identification information into a first terminal connected to a processing unit;

b) performing a first service function on a vehicle at a first station;

c) optionally entering diagnostic information regarding said vehicle at a second terminal positioned at said first station, said second terminal connected to said processing unit;

d) conveying aid vehicle from said first station to a second station on a conveyor that extends from said first station to said second station, said first conveyor being operated by an operator in said fire station;

e) performing a second service function on said vehicle at said second station; and f) optionally entering diagnostic information regarding said vehicle at a third terminal positioned at said second station, said third terminal connected to said processing unit;

wherein one of said stations is a tire changing station comprising a track provided above said station at a height above the top of said vehicle, said track extending at least along one side of a vehicle positioned in said tire changing station; and at least one arm slidably attached to said track, said arm extending downward from said track, said arm having a proximate end opposite said track for receiving and holding a tire, wherein said arm is adapted to carry said tire as said arm slides along said track.

6. The method of claim 5 further comprising the steps of:

g) raising said vehicle by a lift positioned at said tire changing station;

h) positioning at least one of said arms near a tire;

i) placing a tire on said at least one of said arms; and j) positioning said at least one of said arms near a wheel of said vehicle on which said tire is to be placed by sliding said at least one of said arms along said track.

* * * * *